US009840098B2

(12) United States Patent
Elferink

(10) Patent No.: US 9,840,098 B2
(45) Date of Patent: Dec. 12, 2017

(54) PRINTER FOR PRINTING ON A MEDIUM

(71) Applicant: OCE-TECHNOLOGIES B.V., Venlo (NL)

(72) Inventor: Maarten J. H. Elferink, Venlo (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 15/369,327

(22) Filed: Dec. 5, 2016

(65) Prior Publication Data

US 2017/0080728 A1 Mar. 23, 2017

Related U.S. Application Data

(63) Continuation of application No. PCT/EP2015/063696, filed on Jun. 18, 2015.

(60) Provisional application No. 62/014,452, filed on Jun. 19, 2014.

(30) Foreign Application Priority Data

Sep. 18, 2014 (EP) ..... 14185436

(51) Int. Cl.
*B41J 2/01* (2006.01)
*B41J 25/00* (2006.01)

(52) U.S. Cl.
CPC ..... *B41J 25/003* (2013.01); *B41J 2/01* (2013.01); *B41J 25/001* (2013.01); *B41J 25/005* (2013.01); *B41J 2202/14* (2013.01)

(58) Field of Classification Search
CPC .. B41J 2/1752; B41J 2/17523; B41J 2/17553; B41J 11/20; B41J 25/308; B41J 25/34; B41J 2/01; B41J 2202/20; B41J 25/001; B41J 2202/14; B41J 25/003; B41J 25/005
USPC ..... 347/8, 37, 38, 86, 104
See application file for complete search history.

(56) References Cited

U.S. PATENT DOCUMENTS

| | | | | |
|---|---|---|---|---|
| 6,657,822 | B1 * | 12/2003 | Nakamura | G11B 5/60 360/265.6 |
| 2002/0126169 | A1 | 9/2002 | Wyngaert et al. | |
| 2002/0158144 | A1 | 10/2002 | Anderson et al. | |
| 2005/0156963 | A1 | 7/2005 | Song et al. | |
| 2013/0257983 | A1 | 10/2013 | Iesaki | |

FOREIGN PATENT DOCUMENTS

| | | | |
|---|---|---|---|
| CA | 2 862 582 | A1 | 7/2013 |
| EP | 0 693 382 | A1 | 1/1996 |
| WO | WO 2014-005608 | A1 | 1/2014 |

* cited by examiner

*Primary Examiner* — Jannelle M Lebron
(74) *Attorney, Agent, or Firm* — Birch, Stewart, Kolasch & Birch, LLP

(57) ABSTRACT

A printer includes a print head fastening facing a medium support surface; a scanning print carriage being movable along a guide in a scanning direction (Y); and a transporter for transporting the medium in a transport direction (X). The printer includes a suspension structure connecting the print head fastening to the scanning print carriage while allowing movement of the print head fastening with respect to the scanning print carriage in a direction (X) parallel to the transport direction. The suspension structure is elastically deformable to allow for the movement in said direction (X).

18 Claims, 6 Drawing Sheets

PRINTER FOR PRINTING ON A MEDIUM

CROSS REFERENCE TO RELATED APPLICATIONS

This application is a Continuation of PCT International Application No. PCT/EP2015/063696, filed on Jun. 18, 2015, which claims priority under 35 U.S.C. 119(e) to U.S. Provisional Application No. 62/014,452, filed on Jun. 19, 2014 and under 35 U.S.C. 119(a) to patent application Ser. No. 14/185,436.4, filed in Europe on Sep. 18, 2014, all of which are hereby expressly incorporated by reference into the present application.

FIELD

The invention relates to a printer for printing on a medium, the printer comprising:

a medium support surface for supporting the medium;

a print head fastening for fastening a print head facing the medium support surface;

a guide extending over the medium support surface;

a scanning print carriage being movable along the guide in a scanning direction (Y) to move the print head fastening; and, a transporter for transporting the medium and the scanning print carriage with respect to each other in a transport direction (X) parallel to the medium support surface and substantially perpendicular to the scanning direction (Y), wherein the printer comprises a suspension structure connecting the print head fastening to the scanning print carriage while allowing movement of the print head fastening with respect to the scanning print carriage in a direction (X) parallel to the transport direction.

BACKGROUND

The print head is moveable along a scanning direction for applying an ink image to a swath of the medium. The medium, such as a paper sheet, can be stepwise advanced in the transport direction so as to allow an empty swath of the medium to be moved under the print head and be printed. During the printing of an image, the carriage is driven back and forth along the scanning direction to print successive swaths with the print head. A transporter is provided for stepwise advancing of the medium between each successive swath.

The accurate positioning by the transporter of the stepwise advancing medium with respect to the print head is very important. The need for precise positioning of the medium is increased when the printer is a high-resolution printer used for printing graphics with high resolution. The precision requirements for the positioning of the medium are therefore increasing.

Several solutions have been proposed. In particular, the accuracy of the positioning of the print heads relative to the print head fastening has been improved using a number of techniques, such as the addition of an additional actuator to move the print head, e.g. in the medium transport direction or in a rotational motion, for calibrating the position of each print head relative to the print head fastening and/or relative to other print heads.

However, these solutions for position calibration do not take into account any mispositioning due to in accuracy in the advancement of the recording medium in the transport direction. Moreover, with increasing speed and productivity, it becomes more challenging to provide for a transporter that is enabled to transport the medium in a short period with high accuracy. If at all technically possible, the costs for such a transporter would become economically unfeasible.

SUMMARY

It is an objective to provide an improved printer which allows for a highly accurate positioning of the print head and the recording medium relative to each other.

Accordingly there is provided a printer for printing on a medium, the printer comprising a medium support surface for supporting the medium; a print head fastening for fastening a print head facing the medium support surface; a guide extending over the medium support surface; a scanning print carriage being movable along the guide in a scanning direction (Y) to move the print head fastening; and a transporter for transporting the medium and the scanning print carriage with respect to each other in a transport direction (X) parallel to the medium support surface and substantially perpendicular to the scanning direction (Y). In the printer according to the present invention the suspension structure is elastically deformable and connects the print head fastening to the scanning print carriage while allowing movement of the print head fastening with respect to the scanning print carriage in a direction (X) parallel to the transport direction.

With such a moveable print head fastening, any inaccuracy in the positioning of the recording medium may be compensated by adjusting the position of the print head fastening relative to the print head carriage and thus relative to the recording medium.

US 2002/158144 A1 describes a fluid ejecting method and system including one or more fluid ejectors within a fluid ejector frame. The fluid ejector frame is moveably arranged in an interposer frame for enabling an increased print resolution compared to the print head nozzle resolution. The disclosure is however silent about the support structure for the fluid ejector frame.

The suspension structure as used in the present invention supports the print head fastening, while being elastically deformable. This prevents that elements of the print head fastening and the scanning print carriage that contact each other need to slide or otherwise generate friction when the print head fastening is moved relative to the scanning print carriage. Controlling friction forces to enable an accurate positioning is difficult. In particular, static friction forces are generally stronger than dynamic friction forces. So, in order to move two elements relative to each other, first the static friction forces need to be overcome. To overcome the static friction forces an applied force exceeding the static friction forces is needed. As soon as such applied force exceeds the static friction force, a relative movement occurs. Consequently, the dynamic friction forces become dominant, but these are considerably smaller than the static friction forces and thus considerably smaller than the applied force, resulting in a sudden and uncontrollable relative movement. Using an elastically deformable suspension structure circumvents the generation of friction forces and thereby enables accurate control of the positioning of the print head fastening relative to the scanning carriage.

Further, using elasticity in the suspension structure diminishes any hysteresis in back- and forward movements.

It is noted that the application of a suspension structure enables the compensation of inaccuracies of a recording medium transport. The scope of applicability is not limited to such application. For example, it may as well be used for ease of calibration of the print head position or isolating certain vibrations generated in another part of the printer. Other applications are deemed to be apparent to those skilled in the art.

In an embodiment, the suspension structure is elastically deformable corresponding to one translational and one rotational degree of freedom of the print head fastening with respect to the scanning print carriage, said degrees of freedom being:

- a translation in the transport direction (X); and
- a rotation ($R_z$) around an axis (Z) perpendicular to the medium support surface.

The suspension structure allows the print head fastening to move with respect to the scanning print carriage and thus with respect to the medium support surface, as mentioned above. In this embodiment, not only translational errors in the position of the print head on the print head fastening relative to the recording medium can be easily remedied, but also any rotational errors may be compensated by moving or rotating the print head fastening to the correct position. Thus, the relatively simple suspension structure according to this embodiment allows for the compensation of rotational as well directional (i.e. translational) errors in a recording medium position. Furthermore, as mentioned above, in such an elasticity-based suspension system there is no friction or hysteresis, resulting in a high precision position system. Additional advantages of the elasticity-based suspension structure are low maintenance (no lubrication is required) and a relatively long life time (wear is minimal).

An unconstrained print head fastening with respect to the scanning print carriage has at least six degrees of freedom (DOFs), three translation DOFs (X, Y, Z) perpendicular to one another and three rotational DOFs ($R_x$, $R_y$, $R_z$) around axes perpendicular to one another. Preferably the print head fastening is stiff (e.g. torsional stiff or non-deformable), but additional DOFs may be present, due to deformations of the print head fastening. Likewise, it may be preferred that the print head fastening is not enabled to move in one or more of the said six degrees of freedom. It is within the scope of the present invention to provide additional constraining elements, such as additional (leaf) springs, to constrain the print head fastening's motion and/or position with respect to the print head carriage in these DOFs. Preferably, these additional constraining elements are selected such that no friction during a desired motion in another DOF is introduced.

Furthermore, it is within the scope of the present invention to apply one or more print heads on a print head fastening according to the present invention.

In an embodiment the suspension structure is further arranged for constraining the position and/or motion of the print head fastening with respect to the scanning print carriage corresponding to at least three degrees of freedom of the scanning print carriage with respect to the scanning print carriage, said degrees of freedom preferably being:

- a translation in a direction (Z) perpendicular to the medium support surface;
- a rotation ($R_x$) around an axis parallel to the transport direction (X); and
- a rotation ($R_y$) around an axis parallel to the scanning direction (Y).

By constraining motion in these degrees of freedom other than (X, $R_z$) allows for accurate control of the position of the print head with respect to the medium, which increases the accuracy of the printer. Preferably, the spring structure is further arranged for constraining the position and/or motion of the print head fastening with respect to the scanning print carriage in the scanning direction (Y). Thus, highly accurate control of the print head with respect to the medium is achieved, since movement is the directions (Y, Z) and rotations ($R_x$, $R_y$) is constrained whereas corrections can be made in the (X) and ($R_z$) DOFs.

The suspension structure according to the present invention essentially has an elasticity to allow movement of the print head fastening with respect to the scanning print carriage in a direction (X) parallel to the transport direction. Elasticity is used here in reference to spring-like qualities. Low elasticity, i.e. having a high elastic modulus, implies a resilient object, like a stiff spring, for example a Hookean spring with a large spring constant. In contrast, high elasticity, i.e. having a low elastic modulus, is meant to describe flexible spring like qualities, such as a Hookean spring with a low spring constant. The elasticity of the suspension structure as applied in the present invention may be suitably selected by the skilled person such to meet any requirements of the printer.

According to an embodiment the suspension structure connecting the print head fastening to the scanning print carriage allows movement of the print head fastening with respect to the scanning print carriage in a rotational direction around an axis (Z) perpendicular to the medium support surface. Rotation is possible since the spring structure constrains movement in the scanning direction (Y), but allows rotation around the axis (Z) perpendicular to the medium support surface. Any rotational offset or deviation of the print head with respect to the medium can thus be easily corrected by rotating the print head fastening. Similarly, a translational offset or deviation in the transport direction can be corrected by moving the print head fastening in the transport direction.

According to an embodiment the printer comprises an actuator connecting the scanning print carriage and the print head fastening to move the print head fastening in a direction substantially parallel to the transport direction. By providing an actuator connecting the scanning print carriage and the print head fastening the print head may be positioned with the required high precision in the transport direction.

According to an embodiment the printer comprises at least two actuators connecting the scanning print carriage and the print head fastening to move the print head fastening in a direction substantially parallel to the transport direction (X) and in a rotational direction around an axis (Z) substantially perpendicular to the medium support surface, when the at least two actuators actuate in the same direction. The at least two actuators are preferably provided on opposing sides of the print head fastening. By providing at least two actuators connecting the scanning print carriage and the print head fastening the print head may be positioned with the required high precision in the transport direction and in a rotational direction around an axis (Z) substantially perpendicular to the medium support surface, when the at least two actuators actuate in opposite direction. Thus, the at least two actuators can collaborate to provide a simple and high precision print head positioning system which can correct translational as well as rotational errors in the print head positioning.

According to a further embodiment the suspension structure may comprise a leaf spring providing a first elasticity in the direction parallel to the transport direction (X) and a second elasticity in the scanning direction (Y), the first elasticity being higher than the second elasticity. The leaf spring acts as a flexible spring in the transport direction (X), such that movement of the print head fastening with respect to the scanning print carriage is allowed in the transport direction (X), while the leaf spring acts a constraining element in the scanning direction (Y), such that the position and/or motion of the print head fastening with respect to the scanning print carriage is constrained in the scanning direction (Y). The leaf springs have a relatively higher elasticity in the direction parallel to the transport direction (X) to allow for the movement of the print head fastening with respect to the scanning print carriage. The leaf spring may be folded. A fold or a plurality of folds extending in a desired direction (in this case the scanning direction (X)) in the leaf spring may provide the relatively higher elasticity in the right direction (in this case the scanning direction (Y)). Preferably, a plurality of folds extends from at least one end of a leaf spring substantially perpendicular to said leaf spring.

According to a further embodiment the suspension structure comprises a framework of leaf springs. By providing a framework of leaf springs the leaf springs may provide stability to the print head fastening with respect to the scanning print carriage. The crossed leaf spring may constrain the position of the print head fastening with respect to the scanning print carriage in a first direction while providing relatively high elasticity in another direction.

According to an embodiment the framework comprises crossed leaf springs. By providing crossed leaf springs the leaf springs may provide stability to the print head fastening with respect to the scanning print carriage. The crossed leaf springs extend substantially in the scanning direction (Y) between the at least two actuators. The planes of the crossed leaf springs can be oriented substantially parallel to the scanning direction (Y), resulting in a constraining element with a high stiffness in the scanning direction (Y) for constraining the print head fastening in that direction. The crossed leaf springs are arranged at an angle with respect to one another, wherein said angle is increased or decreased when the print head fastening is moved in the transport direction (X) dependent on whether the print head fastening is moving in a forward or backward direction. Thus, the print head fastening can be moved in a controlled manner in the transport direction (X) with relatively little effort. One or more folds can be provided in and/or connected to the leaf spring to provide the flexibility for allowing rotation around the axis (Z) perpendicular to the medium support surface.

According to an embodiment the leaf spring is provided with an opening and/or a reduced width portions. The opening and/or reduced width portion of the leaf spring provide a reduced weight of the suspension construction.

Cut outs also allow for interleaving the leaf springs, therefore increasing the length of the leaf springs in a compact design. Increased length reduces the stress and/or increases the stroke of the leaf spring.

According to a further embodiment the suspension structure comprises rods having a relatively high elasticity in the direction parallel to the transport (X) and the scanning direction (Y) and a relatively low elasticity for a direction perpendicular to the transport and scanning direction. Thus, (controlled) movement of the print head fastening with respect to the scanning print carriage is allowed in the transport direction (X) and the scanning direction (Y). However, the position and/or motion of the print head fastening with respect to the scanning print carriage is constrained in the direction perpendicular to the transport (X) and scanning direction (Y). This latter direction can be the direction (Z) perpendicular to the support surface of the medium. Rotation and translation of the print head carriage can thus be achieved. In contrast to the leaf spring embodiments the rods act as flexible springs in both the transport (X) and scanning direction (Y). Rods can be more compact than leaf springs, i.e. they may take less place than a leaf spring and may therefore be advantageously.

According to an embodiment the suspension structure is provided with an additional leaf spring having a relatively high elasticity in the direction parallel to the transport direction (X) and a relatively low elasticity for directions in the scanning direction (Y) and a direction perpendicular to the scanning and transport direction. By providing an additional leaf spring having a relatively high elasticity in the direction parallel to the transport direction (X) and a relatively low elasticity for directions in the scanning direction (Y) and a direction perpendicular to the scanning and transport direction the required stability in the scanning direction Y may be accomplished. Also a relatively high elasticity may be provided around the Z-axis.

According to a further embodiment there is provided a printer wherein the actuators comprise a Lorentz motor. A Lorentz motor, a motor in which the applied force is linearly proportional to the current and the magnetic field, is advantageously because it only provides a force between two parts while there is no mechanical connection and therefore no friction between the two parts. According to a particular embodiment, the Lorentz motor comprises a voice coil motor. Voice coil motors are relatively simple from design.

According to an embodiment the two actuators are located on two sides of the print head fastening. The two actuators on two sides provide sufficient actuation for the print head fastening in the transport direction (X); and/or the rotational direction around an axis (Z) perpendicular to the medium support surface.

According to an embodiment the printer comprises a controller programmed to: actuate the two actuators in the same direction to move the print head fastening parallel to the transport direction (X); and/or, actuate the two actuators in opposite direction to move the print head fastening in a rotational direction around an axis (Z) perpendicular to the medium support surface.

According to an embodiment the transporter comprises a roll driven by a motor to transport the medium in the transport direction (X).

The roll may be effective in driving the medium through the printer.

According to an embodiment the transporter comprises a drive to move the guide in a direction parallel to the transport direction (X) over the medium support surface.

In this embodiment the medium may be held stationary with respect to the printhead during printing.

In an embodiment, the spring structure is formed by one or more leaf springs extending substantially in the scanning direction (Y) or by one or more rods extending substantially perpendicular to the scanning (X) and transport (Y) directions.

In an embodiment, the one or more leaf springs extend between two actuators on opposing sides of the print head fastening.

BRIEF DESCRIPTION OF THE DRAWINGS

Embodiments of the invention will now be described, by way of example only, with reference to the accompanying schematic drawings in which corresponding reference symbols indicate corresponding parts, and in which.

DETAILED DESCRIPTION OF THE DRAWINGS

Figure 1A:
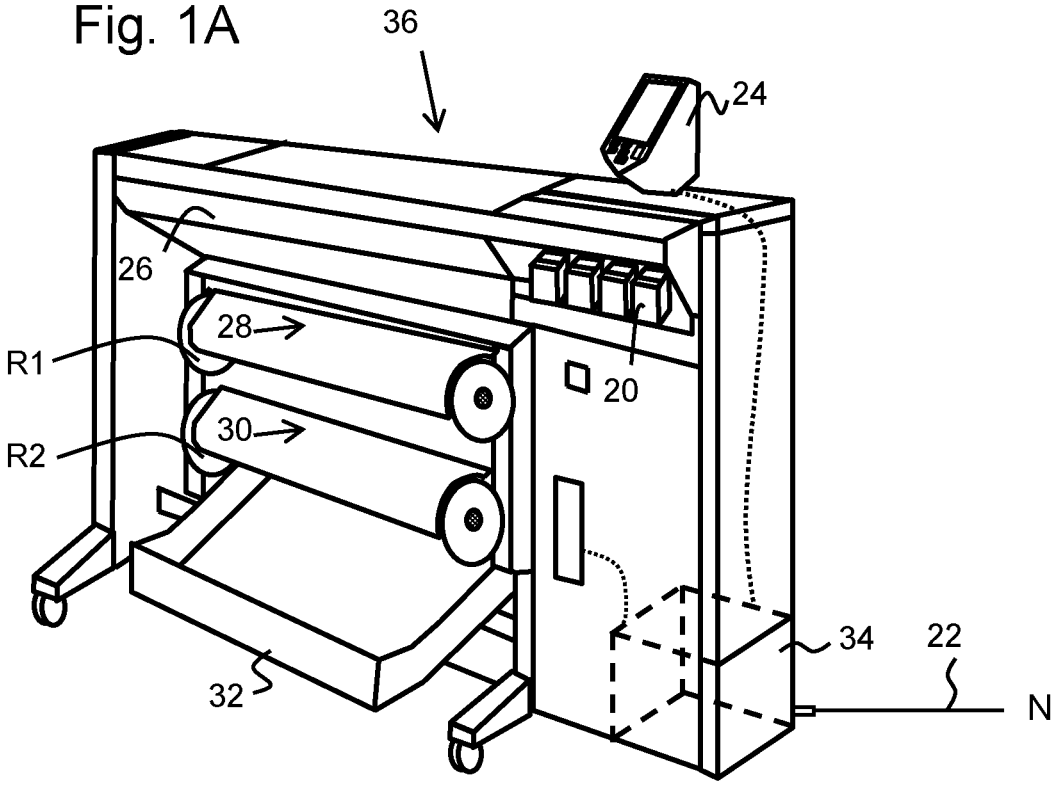
FIG. 1A shows a printer.
Figure 1B:
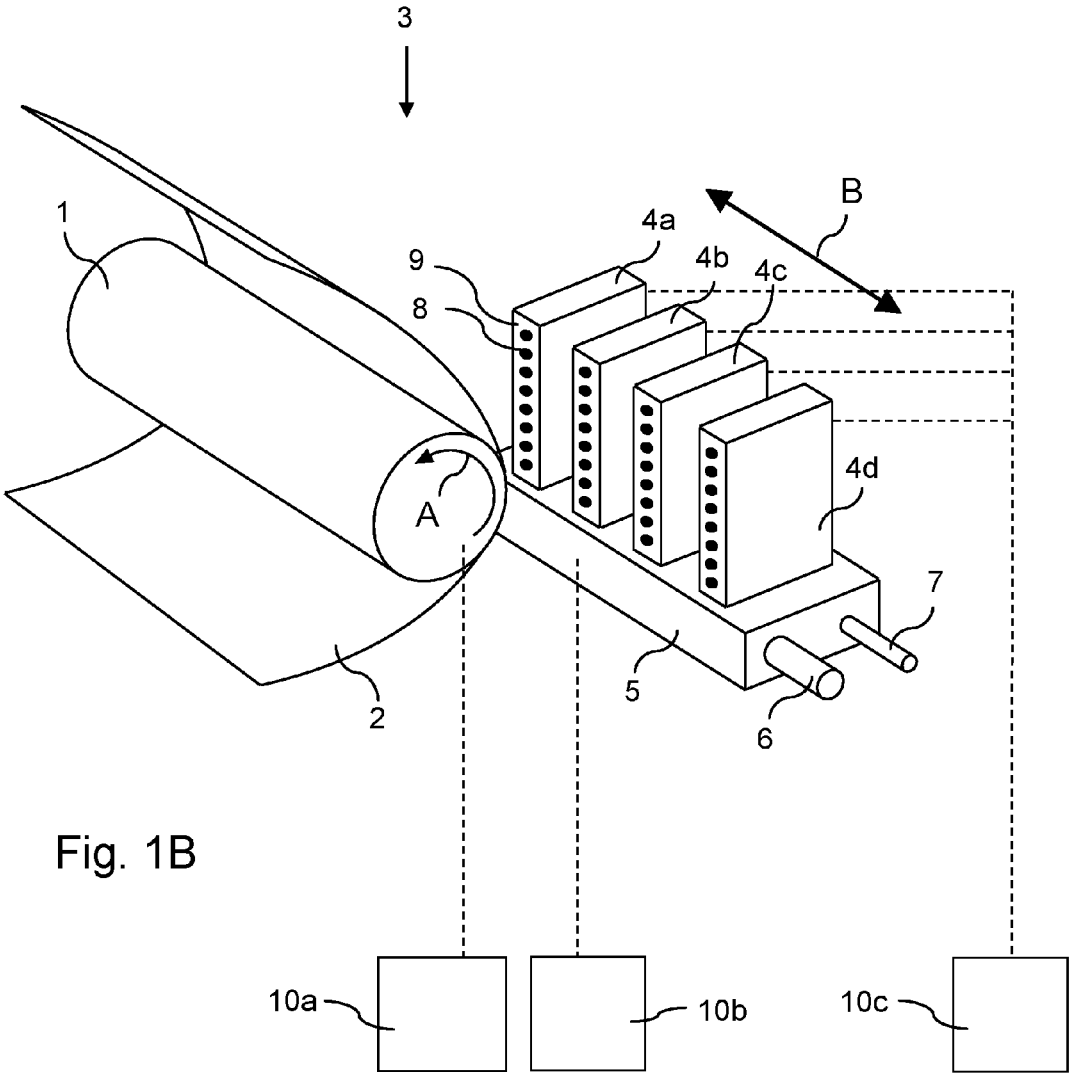
FIG. 1B shows a printing assembly.

FIG. 1A shows a printer such as an image forming apparatus 36, wherein printing is achieved using a wide format inkjet printer. The wide-format image forming apparatus 36 comprises a housing 26, wherein the printing assembly, for example the ink jet printing assembly shown in FIG. 1B is placed. The image forming apparatus 36 also comprises a storage means for storing image receiving member 28, 30, a delivery station to collect the image receiving member 28, 30 after printing and storage means for marking material 20. In FIG. 1A, the delivery station is embodied as a delivery tray 32. Optionally, the delivery station may comprise processing means for processing the image receiving member 28, 30 after printing, e.g. a folder or a puncher. The wide-format image forming apparatus 36 furthermore comprises means for receiving print jobs and optionally means for manipulating print jobs. These means may include a user interface unit 24 and/or a control unit 34, for example a computer.

Images are printed on a medium, for example paper, supplied by a roll 28, 30. The roll 28 is supported on the roll support R1, while the roll 30 is supported on the roll support R2. Alternatively, cut sheet media may be used instead of rolls 28, 30 of medium. Printed sheets of the medium, cut off from the roll 28, 30, are deposited in the delivery tray 32.

Each one of the marking materials for use in the printing assembly are stored in four containers 20 arranged in fluid connection with the respective print heads for supplying marking material to said print heads.

The local user interface unit 24 is integrated to the print engine and may comprise a display unit and a control panel. Alternatively, the control panel may be integrated in the display unit, for example in the form of a touch-screen control panel. The local user interface unit 24 is connected to a control unit 34 placed inside the printing apparatus 36. The control unit 34, for example a computer, comprises a processor adapted to issue commands to the print engine, for example for controlling the print process. The image forming apparatus 36 may optionally be connected to a network N. The connection to the network N is diagrammatically shown in the form of a cable 22, but nevertheless, the connection could be wireless. The image forming apparatus 36 may receive printing jobs via the network. Further, optionally, the controller of the printer may be provided with a USB port, so printing jobs may be sent to the printer via this USB port.

FIG. 1B shows an ink jet printing assembly 3. The ink jet printing assembly 3 comprises a medium support surface for supporting a medium 2. The medium support surface is shown in FIG. 1B as a platen 1, but alternatively, the medium support surface may be a flat surface. The platen 1, as depicted in FIG. 1B, is a rotatable roll, which is rotatable about its axis as indicated by arrow A by a motor. The roll functions as a transporter to move the medium in the transport direction A, X. The medium support surface may be optionally provided with suction holes for holding the medium in a fixed position with respect to the support surface. The ink jet printing assembly 3 comprises print heads 4*a*-4*d*, mounted on a print head fastening for fastening a print head facing the medium support surface in a scanning print carriage 5. The scanning print carriage 5 is guided by suitable guiding means 6, 7 to move in reciprocation in the main scanning direction B, Y. Each print head 4*a*-4*d* comprises an orifice surface 9, which orifice surface 9 is provided with at least one orifice 8. The print heads 4*a*-4*d* are configured to eject droplets of marking material onto the image receiving member 2. The platen 1, the carriage 5 and the print heads 4*a*-4*d* are controlled by suitable controlling means 10*a*, 10*b* and 10*c*, respectively.

The image receiving member 2 may be a medium in web or in sheet form and may be composed of e.g. paper, cardboard, label stock, coated paper, plastic or textile. Alternatively, the medium 2 may also be an intermediate member, endless or not. Examples of endless media, which may be moved cyclically, are a belt or a drum. The medium 2 is moved in the transport direction A, X by the platen 1 along four print heads 4*a*-4*d* provided with a fluid marking material.

A scanning print carriage 5 carries the four print heads 4*a*-4*d* and may be moved in reciprocation in the main scanning direction B, X parallel to the platen 1, such as to enable scanning of the medium 2 in the main scanning direction B, X. Only four print heads 4*a*-4*d* are depicted for demonstrating the invention. In practice an arbitrary number of print heads may be employed. In any case, at least one print head 4*a*-4*d* per color of marking material is placed on the scanning print carriage 5. For example, for a black-and-white printer, at least one print head 4*a*-4*d*, usually containing black marking material is present.

Alternatively, a black-and-white printer may comprise a white marking material, which is to be applied on a black image-receiving member 2. For a full-color printer, containing multiple colors, at least one print head 4*a*-4*d* for each of the colors, usually black, cyan, magenta and yellow is present. Often, in a full-color printer, black marking material is used more frequently in comparison to differently colored marking material. Therefore, more print heads 4*a*-4*d* containing black marking material may be provided on the scanning print carriage 5 compared to print heads 4*a*-4*d* containing marking material in any of the other colors. Alternatively, the print head 4*a*-4*d* containing black marking material may be larger than any of the print heads 4*a*-4*d*, containing a differently colored marking material.

The carriage 5 is guided by a guide 6, 7. The guide 6, 7 may be rods as depicted in FIG. 1B. The rods may be driven by suitable driving means (not shown). Alternatively, the carriage 5 may be guided by another guide, such as an arm being able to move the carriage 5. Another alternative is to move the medium 2 in the main scanning direction B, X.

Each print head 4*a*-4*d*, comprises an orifice surface 9 having at least one orifice 8, in fluid communication with a pressure chamber containing fluid marking material provided in the print head 4*a*-4*d*. On the orifice surface 9, a number of orifices 8 is arranged in a single linear array parallel to the sub-scanning direction A. Eight orifices 8 per print head 4*a*-4*d*, are depicted in FIG. 1B, however obviously in a practical embodiment several hundreds of orifices 8 may be provided per print head 4*a*-4*d*, optionally arranged in multiple arrays. As depicted in FIG. 1B, the respective print heads 4*a*-4*d*, are placed parallel to each other such that corresponding orifices 8 of the respective print heads 4*a*-4*d*, are positioned in-line in the main scanning direction B. This means that a line of image dots in the main scanning direction B may be formed by selectively activating up to four orifices 8, each of them being part of a different print head 4*a*-4*d*. This parallel positioning of the print heads 4*a*-4*d*, with corresponding in-line placement of the orifices 8 is advantageous to increase productivity and/or improve print quality. Alternatively multiple print heads 4*a*-4*d*, may be placed on the print carriage adjacent to each other such that the orifices 8 of the respective print heads 4*a*-4*d* are positioned in a staggered configuration instead of in-line. For instance, this may be done to increase the print resolution or to enlarge the effective print area, which may be addressed in a single scan in the main scanning direction. The image dots are formed by ejecting droplets of marking material from the orifices 8.

Upon ejection of the marking material, some marking material may be spilled and stay on the orifice surface 9 of the print head 4*a*-4*d*. The ink present on the orifice surface 9, may negatively influence the ejection of droplets and the placement of these droplets on the image receiving member 2. Therefore, it may be advantageous to remove excess of ink from the orifice surface 9. The excess of ink may be removed for example by wiping with a wiper and/or by application of a suitable anti-wetting property of the surface, e.g. provided by a coating.

Figure 2A:
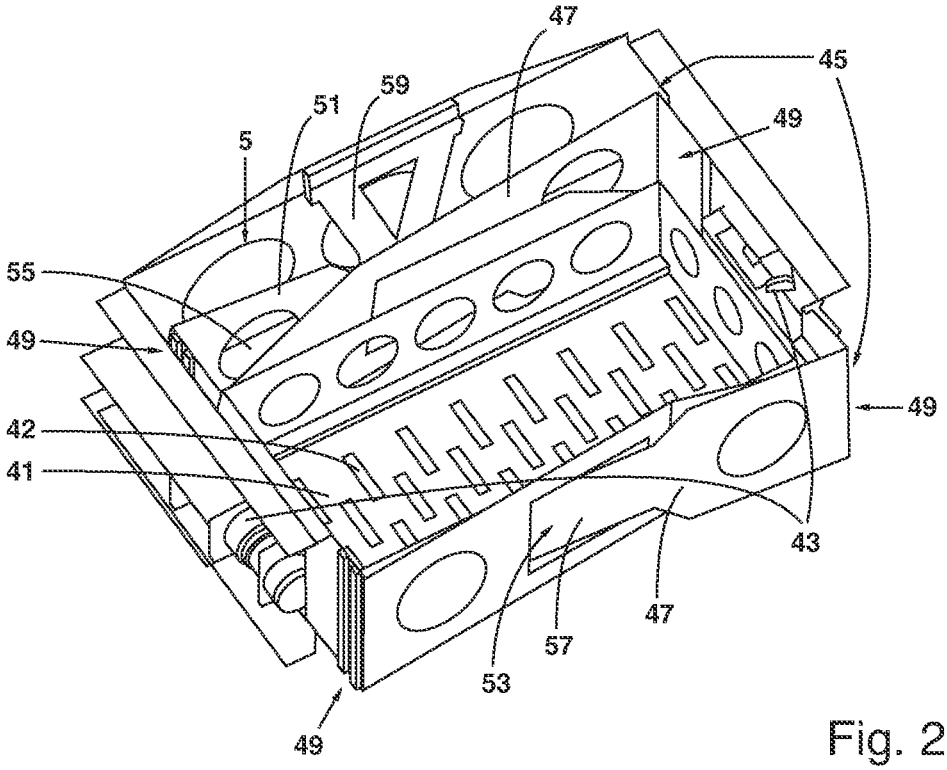
FIG. 2A depicts details of the scanning print carriage of FIG. 1B.

FIG. 2A depicts details of the scanning print carriage 5 of FIG. 1B which is guided by guide 6, 7 to move in reciprocation in the main scanning direction Y (B in FIG. 1B). The carriage 5 comprises a print head fastening 41 for fastening a print head facing the medium support surface. The print head fastening 41 may be provided with holes 42 to provide space for the print heads 4*a* . . . 4*d*. The scanning print carriage 5 is being movable along the guide over the medium in a scanning direction (B, Y) to move the print head fastening 41. A transporter is provided for transporting the medium and the scanning print carriage with respect to each other in a transport direction (A, X) parallel to the medium support surface 1 and substantially perpendicular to the scanning direction (B, Y).

The printer may comprise an actuator 43 connecting the scanning print carriage 5 and the print head fastening 41 to move the print head fastening 41 in a direction substantially parallel to the transport direction (X). With the actuator 43 errors in the positioning of the medium in the transporting direction by the transporter may be corrected.

The printer may comprise at least two actuators 43 connecting the scanning print carriage 5 and the print head fastening 41 to move the print head fastening 41 in a direction substantially parallel to the transport direction (X) and in a rotational direction around an axis (Z) substantially perpendicular to the medium support surface. The two actuators 43 may be located on two opposite sides of the print head fastening 41.

The actuators 43 may be a Lorentz motor. Lorentz motors are actuators in which the applied force is linearly proportional to the current and the magnetic field. This is advantageously because they only provide a force between two parts while not transmitting vibrations between the two parts. A separate measurement system, for example an optical encoder system, may be used for measuring the position of the print head fastening 41 with respect to the carriage 5. The measurement system may be connected to a controller. The controller may be connected to the actuators 43 to control the actuators 43. The controller may be programmed to:

actuate the two actuators in the same direction to move the print head fastening parallel to the transport direction (X); and/or, actuate the two actuators in opposite direction to move the print head fastening in a rotational direction around an axis (Z) perpendicular to the medium support surface. The Lorentz motor may be a voice coil motor. Voice coil motors are relatively simple from design.

The actuators may be a lead screw which is more difficult to control due to hysteresis due to friction in the required precision. Other actuators may, for example, include a cam drive or a piezo.

The printer may have a suspension structure 45 connecting the print head fastening 41 to the scanning print carriage 5 while allowing movement of the print head fastening with respect to the scanning print carriage in a direction (A, X) parallel to the transport direction. The suspension structure 45 allows movement of the print head fastening 41, which may hold a printing head or array with respect to the scanning print carriage in a direction (X) parallel to the transport direction.

The printer may have a suspension structure 45 connecting the print head fastening 41 to the scanning print carriage 5 while allowing movement of the print head fastening with respect to the scanning print carriage in a direction (A, X) parallel to the transport direction and in a rotational direction around an axis (Z) perpendicular to the medium support surface (e.g. perpendicular to X and Y).

The suspension structure may have leaf springs 47 with a relatively high elasticity in the direction parallel to the transport direction (X) and a relatively low elasticity in the scanning direction (Y). The leaf springs 47 may be provided with a first leaf spring portion 49 and a second leaf spring portion 51 to provide the required flexibility. As depicted the suspension structure 45 comprises a framework of leaf springs 47. The leaf springs 47 of the framework may be crossed in a middle portion 53 to create extra length in a compact design. The crossing leaf springs 47 constrain the position of the print head fastening 41 in the scanning direction (Y), whereas the leaf springs 47 allow for motion of the print head fastening 41 in the transport direction (X). The crossed leaf springs 47 are thus arranged to constrain four degrees of freedom of the print head fastening and/or the print head carriage: (Y, Z, $R_x$, $R_y$). The suspension structure 45 is provided with an additional leaf spring 59 having a relatively high elasticity (i.e. a weak spring) in the direction parallel to the transport direction (X) and a relatively low elasticity (i.e. a stiff spring) for directions in the scanning direction (Y) and a direction perpendicular to the scanning and transport direction.

Figure 2B:
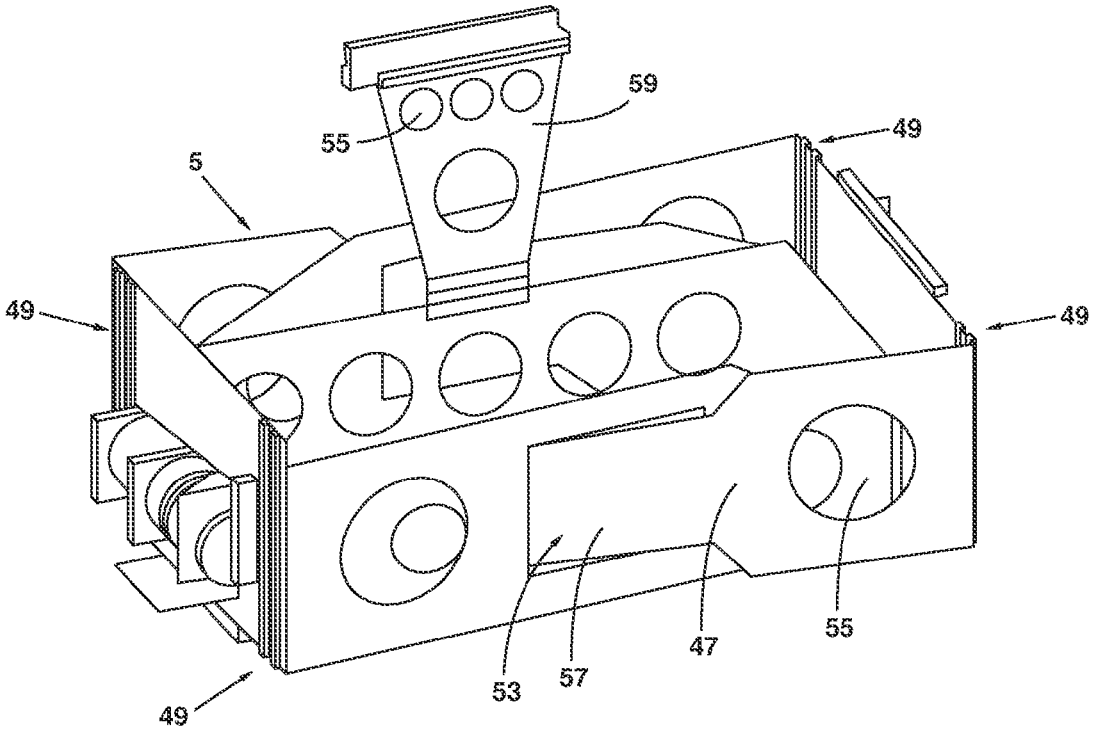
FIG. 2B depicts a side view of a scanning print carriage.

FIG. 2B depicts a side view of the carriage 5 of FIG. 1A with a differently designed additional leaf spring 59. The additional leaf spring 59 has a relatively high elasticity (i.e. a low spring constant) in the direction parallel to the transport direction (X) and a relatively low elasticity (i.e. a high spring constant) for directions in the scanning direction (Y) and a direction perpendicular to the scanning and transport direction. The leaf springs 47, 49, 59 may be provided with openings 55 and/or reduced width portions 57 to save weight.

In an alternative embodiment the transporter may comprises a drive to move the guide in a direction parallel to the transport direction (X) over the medium support surface. In this case the medium may be held stationary while the carriage is moved over the medium in X and Y.

Figure 3:
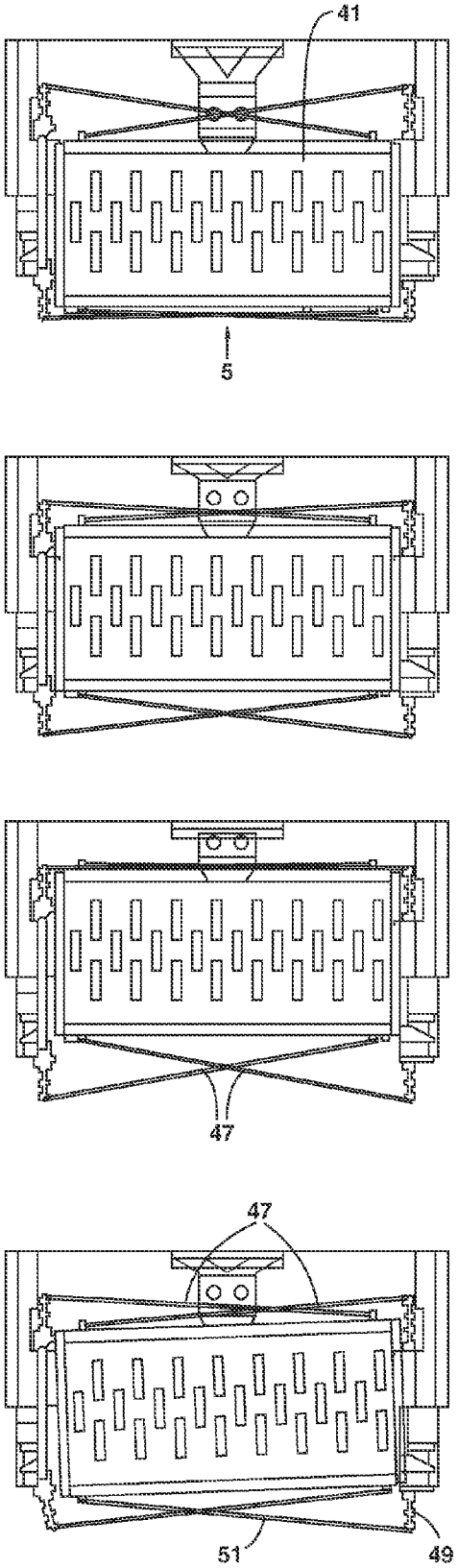
FIG. 3 depicts a top view on the scanning print carriage in four different positions; and, FIG. 4 depicts an embodiment in which the suspension structure comprises rods.

FIG. 3 depicts a top view on the scanning print carriage 5 in four different positions of the print head fastening 41 with respect to the carriage. What is shown is that the leaf springs 47 allow for flexible movement of the print head fastening 41. The first leaf spring portion 49 and the second leaf spring portion 51 provide the required flexibility. The leaf springs 47 constrain the position of the print head fastening 41 with respect to the carriage 5. The print head fastening 41 is able to move in the transport direction (X), being the vertical direction when viewing FIG. 3 in portrait view, while being constrained in directions perpendicular thereto, such as the scanning direction (Y) and/or (Z). Additionally rotations (Rx) and ($R_y$) of the print head fastening 41 are constrained by the spring structure, while rotation ($R_z$) is allowed. Actuating both actuators 43 on opposite sides of the print head fastening 41 in the same direction moves the print head fastening 41 with respect to the carriage 5 in a straight motion in the transport direction (X). As can be seen when viewing the top three figures in FIG. 3 the print head fastening 41 is thus moved in the transport direction (X) (i.e. vertically in FIG. 3) which allows for the correction of translation errors in the position of the print head. In FIG. 3 it can be seen that during movement the angle between the crossed leaf springs 47 at one side (top side in FIG. 3) of the print head fastening 41 increases during movement, while the angle between the crossed leaf springs 47 at the opposite side (bottom side in FIG. 3) of the print head fastening 41 decreases. This allows the print head fastening 41 to be moved in a controlled manner. It is noted that within the scope of the present invention one or more folds in the transport direction (X) can be provided in the leaf spring 47 to increase the flexibility and thus the motion of the print head fastening 41.

The bottom figure of FIG. 3 illustrates the situation when the two actuators 43 on opposite sides of the print head fastening 41 are operated in opposing directions. The print head fastening 41 is thus able to rotate around an axis (Z) perpendicular to the transport (X) and scanning (Y) directions. In this manner, rotational errors in the positioning of the print head can be corrected.

Figure 4:
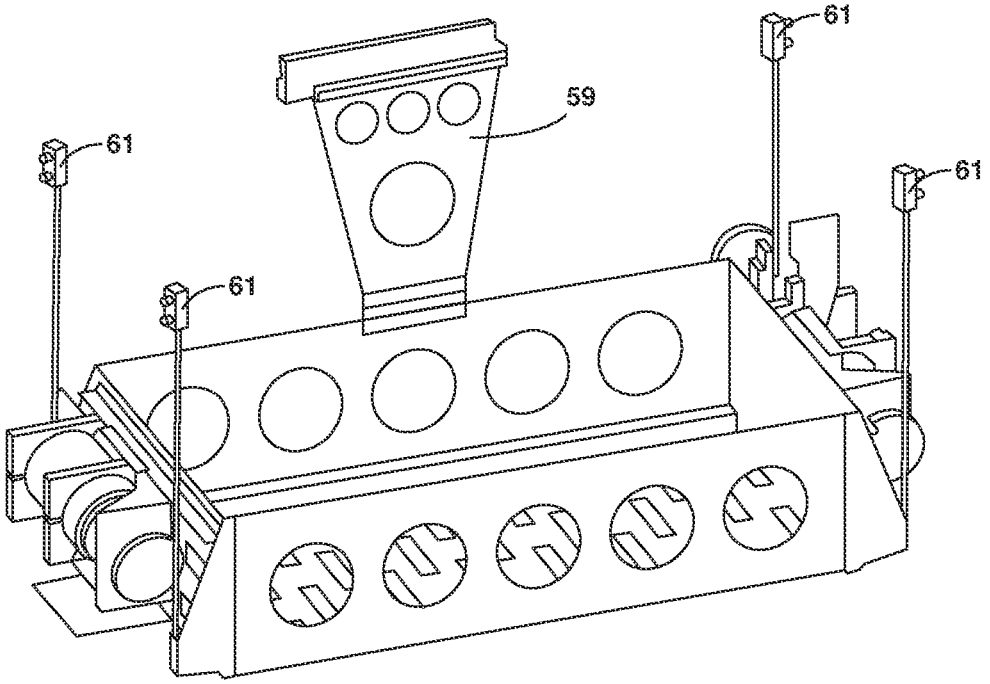

FIG. 4 depicts an embodiment in which the suspension structure comprises rods 61 having a relatively high elasticity in the direction parallel to the transport (X) and the scanning direction (Y) and a relatively low elasticity for a direction perpendicular to the transport and scanning direction. Thus, the rods form flexible spring structure elements in the transport (X) and scanning (Y) directions, while forming resilient spring structure elements or constraining elements in the direction perpendicular thereto. Again an additional leaf spring 59 may be provided. The additional leaf spring 59 having a relatively high elasticity in the direction parallel to the transport direction (X) and a relatively low elasticity for directions in the scanning direction (Y) and a direction perpendicular to the scanning and transport direction. The rods 61 provide for a relatively compact and simple solution compared to other solutions. Depending on the required stroke the rods may provide some displacement of the print head fastening in the Z-direction which may be a disadvantage of the design using the rods.

It is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Furthermore, the terms and phrases used herein are not intended to be limiting, but rather, to provide an understandable description of the invention.

The terms "a" or "an", as used herein, are defined as one or more than one. The term another or subsequent, as used herein, is defined as at least a second or more. The terms including and/or having, as used herein, are defined as comprising (i.e., not excluding other elements or steps). Any reference signs in the claims should not be construed as limiting the scope of the claims or the invention. The mere fact that certain measures are recited in mutually different dependent claims does not indicate that a combination of these measures cannot be used to advantage. The scope of the invention is only limited by the following claims.

The invention claimed is:

1. A printer for printing on a medium, the printer comprising:

a medium support surface for supporting the medium;

a print head fastening for fastening a print head facing the medium support surface;

a guide extending over the medium support surface;

a scanning print carriage being movable along the guide in a scanning direction (Y) to move the print head fastening; and, a transporter for transporting the medium and the scanning print carriage with respect to each other in a transport direction (X) parallel to the medium support surface and substantially perpendicular to the scanning direction (Y); wherein the printer comprises a suspension structure connecting the print head fastening to the scanning print carriage while allowing movement of the print head fastening with respect to the scanning print carriage in a direction parallel to the transport direction (X), wherein the suspension structure is elastically deformable and supports the print head fastening, providing frictionless movement of the print head fastening in said direction parallel to the transport direction (X).

2. The printer according to claim 1, wherein the suspension structure is arranged for allowing, preferably controlled, movement of the print head fastening with respect to the scanning print carriage corresponding to one translational and one rotational degree of freedom of the scanning print carriage with respect to the scanning print carriage, said degrees of freedom being:

a translation in the transport direction (X); and a rotation ($R_z$) around an axis (Z) perpendicular to the medium support surface.

3. The printer according to claim 1, wherein the suspension structure is arranged for constraining the position and/or motion of the print head fastening with respect to the scanning print carriage corresponding to at least three degrees of freedom of the scanning print carriage with respect to the scanning print carriage, said degrees of freedom preferably being:

a translation in a direction (Z) perpendicular to the medium support surface;

a rotation ($R_x$) around an axis parallel to the transport direction (X); and a rotation ($R_y$) around an axis parallel to the scanning direction (Y).

4. The printer according to claim 1, wherein the suspension structure is arranged for constraining the position and/or motion of the print head fastening with respect to the scanning print carriage in the scanning direction (Y).

5. The printer according to claim 1, wherein the suspension structure comprises rods having a first elasticity in the direction parallel to the transport (X) and the scanning direction (Y) and a second elasticity for a direction perpendicular to the transport and scanning direction, wherein the first elasticity is higher than the second elasticity.

6. The printer according to claim 1, wherein the transporter comprises a roll driven by a motor to transport the medium in the transport direction (X).

7. The printer according to claim 1, wherein the transporter comprises a drive to move the guide in a direction parallel to the transport direction (X) over the medium support surface.

8. The printer according to claim 1, wherein the printer comprises an actuator connecting the scanning print carriage and the print head fastening to move the print head fastening in a direction substantially parallel to the transport direction (X).

9. The printer according to claim 8, wherein the actuator comprises a Lorentz motor.

10. The printer according to claim 9, wherein the Lorentz motor is a voice control motor.

11. The printer according to claim 1, wherein the printer comprises at least two actuators on opposing sides of the print head fastening connecting the scanning print carriage and the print head fastening for:

moving the print head fastening in a direction substantially parallel to the transport direction (X), when the at least two actuators actuate in the same direction; and for moving the print head fastening in a rotational direction around an axis (Z) substantially perpendicular to the medium support surface, when the at least two actuators actuate in opposite direction.

12. The printer according to claim 11, wherein the actuator comprises a Lorentz motor.

13. The printer according to claim 12, wherein the Lorentz motor is a voice control motor.

14. The printer according to claim 1, wherein the suspension structure comprises a leaf spring for providing a first elasticity in the direction parallel to the transport direction (X) and a second elasticity in the scanning direction (Y), wherein the first elasticity is higher than the second elasticity.

15. The printer according to claim 14, wherein the suspension structure comprises a framework of leaf springs.

16. The printer according to claim 15, wherein the framework of leaf springs comprises crossed leaf springs.

17. The printer according to claim 15, wherein the leaf springs extend between two actuators on opposing sides of the print head fastening.

18. The printer according to claim 17, wherein the framework of leaf springs comprises crossed leaf springs.

* * * * *